US005992107A

United States Patent [19]

Poirier

[11] Patent Number: 5,992,107

[45] Date of Patent: Nov. 30, 1999

[54] APPARATUS FOR EDGE MOUNTING SECURITY WINDOW FILM IN A WINDOW FRAME

[76] Inventor: Paul W. Poirier, 1634 Carshyl Court, Kelowna, British Columbia, Canada, V1X 6Y7

[21] Appl. No.: 08/880,188

[22] Filed: Jun. 20, 1997

[51] Int. Cl.[6] ..... E06B 1/04

[52] U.S. Cl. ..... 52/203; 52/204.62; 248/205.3; 248/208; 248/220.1; 248/351; 156/71; 156/108; 156/292; 156/598

[58] Field of Search ..... 248/205.3, 208, 248/220.1, 247, 351, 467; 52/204.53, 204.62, 203; 156/108, 290, 292, 598, 71

[56] References Cited

U.S. PATENT DOCUMENTS

| | | | |
|---|---|---|---|
| 3,400,847 | 9/1968 | Sute . | |
| 4,075,802 | 2/1978 | Gross et al. | 52/203 |
| 4,575,036 | 3/1986 | Allekotte . | |
| 4,986,504 | 1/1991 | Gary | 248/205.3 |
| 5,237,788 | 8/1993 | Sandow . | |
| 5,553,422 | 9/1996 | Gazaway | 52/204.53 |
| 5,769,246 | 6/1998 | Estep | 248/205.3 X |

FOREIGN PATENT DOCUMENTS

| | | | |
|---|---|---|---|
| 1325117 | 1/1973 | United Kingdom | 248/205.3 |

OTHER PUBLICATIONS

GlassLock System Diagram Internet Website for Glasslock Obtained Apr. 8, 1997.

*Primary Examiner*—Sam Chuan Yao
*Attorney, Agent, or Firm*—Antony C. Edwards

[57] ABSTRACT

An apparatus for mounting security window film to a window frame, includes an elongate tensile loading transfer member having first and second adjacent elongate load bearing flanges and corresponding first and second respective elongate bearing surfaces thereon, first and second elongate double sided foam adhesive tape strips mountable, on first sides of the adhesive tape strips, along respective the first and second bearing surfaces, the first adhesive tape strip mountable on its second side, opposite to the first side, to an edge of a sheet of security window film having a thickness of at least 10 mil adhered to a glass window pane, the second adhesive tape strip mountable on its second side, opposite to the first side, to an edge of a window frame adjacent the edge of sheet of security window film, wherein, the first and second adhesive tape strips are adapted to bear approximately 225 lbs per square inch in tension applied to the first and second adhesive tape strips and to the security window film when adhesively mounted to the tensile load transfer member by the first adhesive tape strip and to the window frame when mounted to the tensile load transfer member by the second adhesive tape strip.

4 Claims, 7 Drawing Sheets

APPARATUS FOR EDGE MOUNTING SECURITY WINDOW FILM IN A WINDOW FRAME

FIELD OF THE INVENTION

This invention relates to the field of security window film and its application to glass windows, and, in particular, to a method and apparatus for edge mounting security window film in a window frame.

BACKGROUND OF THE INVENTION

Break and entry crimes are a well documented and, apparently, daily occurrence in many, if not all, cities. Break and entry into commercial retail establishments is a particularly vexing problem in that, on the one hand, it is desirable for the retail establishment to have large attractive displays of their wares behind panoramic glass windows so as to advertise and promote the establishment's wares, and on the other hand, such large windows and their associated displays of wares, provide an enticing target for the criminal element who count on being able to break the glass from the outside and grab the wares on display through the open window frame.

In the prior art, it is common, especially in high crime areas, for commercial retail outlets to have either permanently installed metal bars either in front of or behind the glass storefront displays, thereby, marring the attractiveness of the display, or to have pull down shutters or grates so as to lock an obstacle into place between the glass windows and a person attempting to break and enter. Both of these prior art solutions are not only unsightly, but expensive to install and, in the latter case, unreliable to maintain, in that employees must be relied on to lower and lock into place the shutters or grates.

So called security film has become available more recently to address the problem of break and enter through glass windows. Security film is typically a thin, transparent, polymer film providing a resilient high tensile strength barrier which, when adhered against an interior surface of a glass window, resists complete shattering of the glass when an attempt at penetration is made from the outside. One commercial supplier of security window film are Metallized Products in St. Petersburg, Fla., U.S.A., who supply 12 mil and 14 mil cross weaved polyester film under the trademark Sun-gard. Another supplier of security window film is 3M™ who market safety and security film under the trademark Scotchshield. Scotchshield™ is held out by 3M™ as resisting penetration by keeping the glass in place during attempted break-ins, storms and earthquakes.

However, it is the applicant's experience that merely applying security window film is not sufficient in many instances to prohibit break and enter. In particular, it is quite often the case that a glass window, whether it has security film applied or whether it has embedded wire mesh or the like, will not prevent a break and enter at the hands of a determined assailant because the edges of the glass window are typically not secured to the window frame. Consequently, to affect a break and enter, the glass window, held together by its embedded wire mesh or security window film applied to an inner surface, merely has to be broken and bowed sufficiently to draw the edges of the glass free of the window frame, at which point the entire window may be pushed free of the frame.

In the prior art an attempt to overcome this problem has been made by an entity doing business under the trademark Glasslock in San Jose, Calif., U.S.A. The Glasslock™ solution is to extend the edge of security window film beyond the edge of the glass so as to overlap a significant portion of the window frame with security window film. Rigid base plates are then overlaid over the overlapping area. The rigid base plates are screwed into the window frame so as to sandwich the edges of the window security film between the rigid base plate and the window frame. In this fashion, when bowing of the broken glass tensions the film, the tension is resisted by the mechanical mounting of the edges of the window security film to the window frame. In particular, the Glasslock™ device is typically employed to bend the edges of the security window film at 90 degrees to the plane of the window so that the mechanical mounting of the film to the window frame by means of screws through the rigid base plate is assisted by bending of the film around an edge of the plate adjacent the window.

Applicant has determined that it is unnecessary and likely counter-productive to perforate the security window film by screws or the like extending through rigid plates. It is, further, unnecessary to bend the film over the edge of the rigid base plate as a means of applying the tensile load from the film to the rigid base plate, although it does help prevent the film merely tearing free of the mounting screws due to the stress concentrations around the holes punctured in the film by the mounting screws.

It is an object of the present invention to provide an adhesive based method and apparatus for adhesively mounting the edge of security window film to a window frame so as to offer tensile resistance to bowing of the glass once broken, so that the same or better result is achieved as compared with the more difficult to install mechanical Glasslock™ device which requires a significant window frame depth, and requires drilling and screwing of a rigid base plate to the window frame. It is a further object to provide for adhesively mounting the edge of security window film to the edge of the glass window pane.

SUMMARY OF THE INVENTION

Applicant's invention resides in the applicant's discovery that certain commercially available double sided very high bond (VHB) tape, such as that available commercially from 3M™ Industrial Specialties Division of St. Paul, Minn., U.S.A., under the trademark Scotch VHB and in particular, models #4925 and #4945 doubled coated acrylic foam tape, in combination with a thin metal tensile loading transfer strip, resulted, unexpectedly, in significant resistance to bowing of broken glass within a window frame. Applicant has determined that VHB 4945 double sided adhesive tape when used in the method and apparatus of the present invention, resists straight pull tension of approximately 1,000 pounds per square inch on security window film. Applicant has determined that if lesser security applications are required, for example, requiring approximately 225 pounds per square inch, resistance to straight pull tension on the security window film, VHB 4925 double sided adhesive tape may be employed.

Thus, as described herein and as may be seen in the accompanying drawings and photographs, the present invention is one of attractive simplicity. In addition, the present invention is well adapted to retrofitting security window film onto existing glass windows.

In summary, the apparatus of the present invention for mounting security window film to a window frame comprises an elongate tensile loading transfer member having first and second adjacent elongate load bearing flanges and corresponding first and second respective elongate bearing surfaces thereon.

In one embodiment, first and second elongate double sided foam adhesive tape strips are mounted or mountable, on first sides of the adhesive tape strips, along respective the first and second bearing surfaces.

The first adhesive tape strip or mounted or mountable on its second side, opposite to the first side, to an edge of a sheet of security window film having a thickness of at least 10 mil adhered to a glass window pane second adhesive tape strip is mounted or mountable on its second side, opposite to the first side, to an edge of a window frame adjacent the edge of the sheet of security window film.

In a first aspect of the invention, the first and second adhesive tape strips are adapted to bear approximately 225 lbs per square inch in tension applied to the tape strips and to said security window film when adhesively mounted to the tensile load transfer member by said first adhesive tape strip and to the window frame when mounted to the tensile load transfer member by the second adhesive tape strip.

In a second aspect of the invention, the first and second adhesive tape strips are adapted to bear approximately 1000 lbs per square inch in tension applied to the tape strips and to the security window film when adhesively mounted to the tensile load transfer member by the first adhesive tape strip and to said window frame when mounted to the tensile load transfer member by the second adhesive tape strip.

In a further aspect, the tensile load transfer member is a metal strip shaped to conform to the intersection between the edge of the sheet of security window film and the edge of the window frame adjacent the edge of the sheet of security window film, and the first and second flanges extend over the edge of the sheet of security window film and the window frame respectively so as to sandwich the first and second adhesive tape strips respectively between the flanges and the security window film and edge of the window frame respectively.

In a second embodiment, the first adhesive tape strip is mountable to the first bearing surface, and the second load bearing flange is formed as a lip relative to the first load bearing flange for mounting the lip over an edge of the window pane so as to extend the first load bearing flange inwardly over the window pane, from the edge of the window pane, and over the edge of the sheet of security window film to thereby sandwich the first adhesive tape strip between the first load bearing flange and the edge of the sheet of security window film.

In the method of the present invention, a first method of mounting security window film to a window frame using an elongate tensile loading transfer member having first and second adjacent elongate load bearing flanges and corresponding first and second respective elongate bearing surfaces thereon, first and second elongate double sided foam adhesive tape strips mountable, on first sides of the adhesive tape strips, along respective said first and second bearing surfaces, the first adhesive tape strip mountable on its second side, opposite to the first side, to an edge of a sheet of security window film having a thickness of at least 10 mil adhered to a glass window pane, the second adhesive tape strip mountable on its second side, opposite to the first side, to an edge of a window frame adjacent the edge of sheet of security window film, wherein the first and second adhesive tape strips are adapted to bear 225 lbs per square inch in tension applied to the tape strips and to the security window film when adhesively mounted to the tensile load transfer member by the first adhesive tape strip and to the window frame when mounted to the tensile load transfer member by the second adhesive tape strip, comprises the steps of:

(a) cutting the sheet of security window film sized to fit from edge to edge across the window pane when adhered thereto, (b) adhering the sheet of security window film to the window pane from edge to edge and allowing to cure, (c) selecting, or shaping, the tensile load transfer member of, or to, a shape wherein the tensile load transfer member is shaped to conform to the intersection between the edge of the sheet of security window film and the edge of the window frame adjacent the edge of the sheet of security window film, and the first and second flanges extend over the edge of the sheet of security window film and the window frame respectively so as to sandwich the first and second adhesive tape strips respectively between the flanges and the security window film, (d) applying the first and second adhesive tape strips to the first and second flanges respectively, (e) applying the load transfer member to the sheet of security window film and the window frame so that the first and second flanges extend over the edge of the sheet of security window film and the window frame respectively and so as to sandwich the first and second adhesive tape strips respectively between the flanges and the security window film.

In a second method of the present invention, a method of mounting security window film to a window frame using an elongate tensile loading transfer member having first and second adjacent elongate load bearing flanges and corresponding first and second respective elongate bearing surfaces thereon; a first elongate double sided foam adhesive tape strip mountable, on a first side of the adhesive tape strip, along the first bearing surfaces, the first adhesive tape strip mountable on its second side, opposite to the first side, to an edge of a sheet of security window film having a thickness of at least 10 mil adhered to a glass window pane, wherein the first adhesive tape strip is adapted to bear 225 lbs per square inch in tension applied to the tape strip and to the security window film when adhesively mounted to the tensile load transfer member by the first adhesive tape strip, wherein the second load bearing flange is a lip for mounting over an edge of the glass window pane so as to extend the first load bearing flange inwardly over the window pane, from the edge of the window pane, and over the edge of said sheet of security window film to thereby sandwich the first adhesive tape strip between the first load bearing flange and the edge of the sheet of security window film, comprising the steps of:

(a) cutting the sheet of security window film sized to fit from edge to edge across the window pane when adhered thereto, (b) adhering the sheet of security window film to the window pane from edge to edge and allowing to cure, (c) selecting, or shaping, the tensile load transfer member of, or to, a shape wherein the tensile load transfer member is shaped to conform to the edge of the glass window pane generally adjacent the intersection between the edge of the sheet of security window film and the edge of the window frame adjacent the edge of the sheet of security window film, and the first flange extends over the edge of the sheet of security window film so as to sandwich the first adhesive tape strip between the flange and the security window film, (d) applying the first adhesive tape strip to the first flange, (e) applying the load transfer member to the sheet of security window film and the glass window pane so that the first flange extends over the edge of the sheet of security window film and the glass window pane and so as to sandwich the first adhesive tape strip between the flange and said security window film.

DETAILED DESCRIPTION OF THE PREFERRED EMBODIMENT

Figure 1:
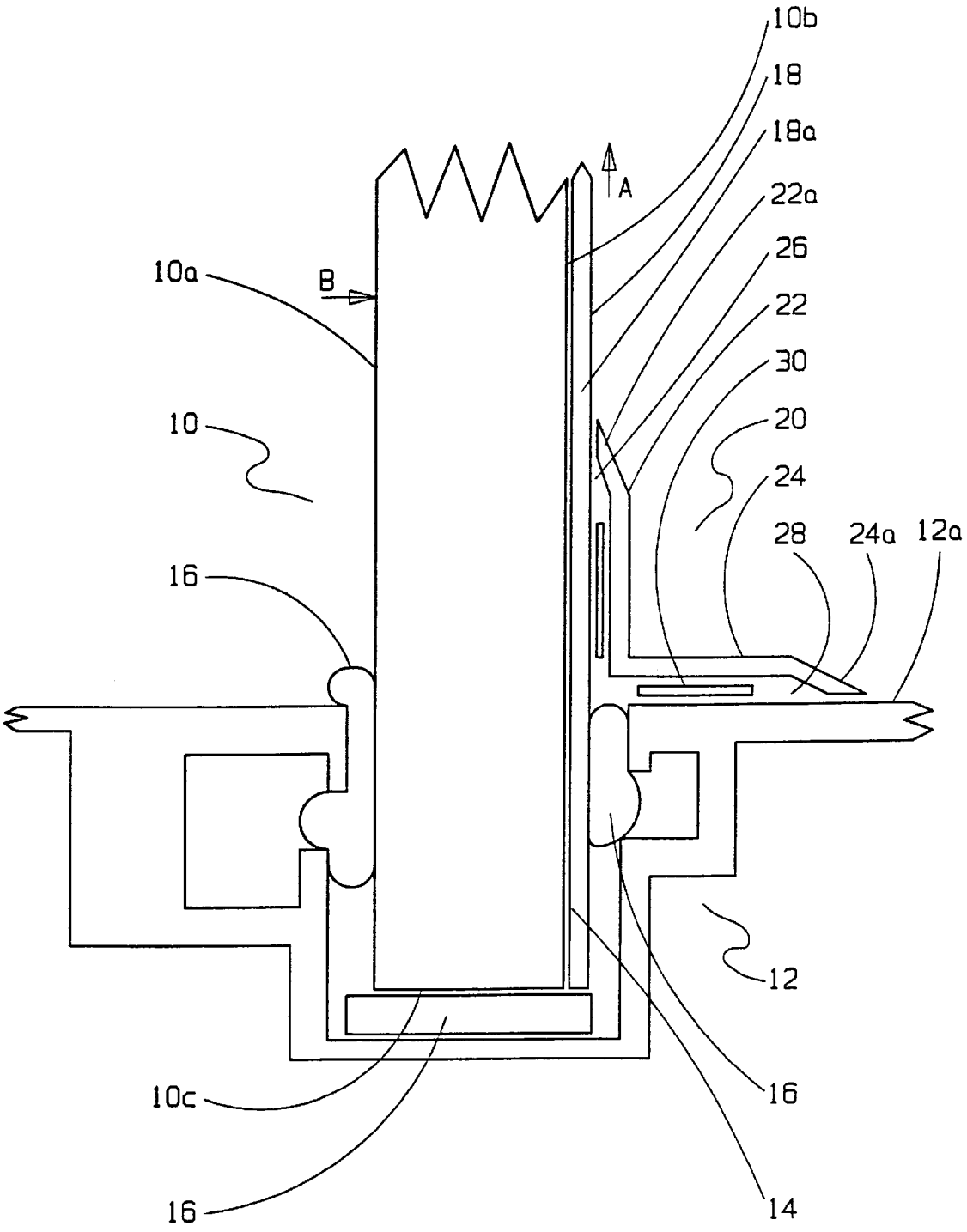
FIG. 1 is, in an enlarged partially broken away cross-sectional view, the adhesive edge mounting of a security window film to a window frame of the present invention.

As may be seen in FIG. 1, in a typical arrangement, glass window pane 10 is mounted within window frame 12 within channel 14 and secured between resilient gaskets 16. Glass window pane 10 has outwardly facing exterior surface 10*a* and inwardly facing interior surface 10*b*.

Security window film 18, which advantageously may be 12 mil or 14 mil cross weaved polyester film is cut to the size of the exposed or exposable area of window frame 12 and mounted thereto by methods well known in the art.

An appropriately shaped tensile loading transfer strip 20 is selected depending on the manner in which the edge portion of 18*a* of security window film 18 is to be adhesively mounted and secured to either interior surface 12*a* of window frame 12 or edge 10*c* of glass windowpane 10.

In the embodiment illustrated in FIG. 1, tensile loading transfer strip 20 is, in cross section, bent at 90 degrees so that first bearing flange 22 is at right angles to second bearing flange 24. The edges 22*a* and 24*a* of first and second bearing flanges 22 and 24 are bent, and in particular at least edge 24*a*, so as to form cavities 26 and 28 between, respectively, first and second bearing flanges 22 and 24 when tensile loading transfer strip 20 is mounted as illustrated into the intersection between security window film 18, at edge portion of 18*a*, and window frame 12 at interior surface 12*a*. Cavities 26 and 28 are sized to respectively accommodate snugly therein corresponding strips of double sided adhesive tape 30 such as VHB 4925 double sided foam tape for low security applications and VHB 4945 double sided foam tape for high security applications.

Double sided tape strips 30 provide resilient adhesive bonding between edge portion 18*a* and first bearing flange 22 and between interior surface 12*a* and second bearing flange 24. Once adhered, double sided tape strips 30 act to transfer a tensile load in direction A on security window film 18 such as would occur if glass window pane 10 was broken inwardly in direction B, and transfers the tensile load via double sided tape strips 30 and tensile loading transfer strip 20 to interior surface 12*a* and window frame 12.

Tensile loading transfer strip 20 is preferably a metal strip advantageously according to the following specifications:

| | | | | |
|---|---|---|---|---|
| Galvanized | | Carbon manganese | | |
| CQ | | Commercial Quality | | |
| ASTM | | A526 R-A653 (m) | | |
| SAE | | 1006–1012 | | |
| Chemical Composition % Max | | C.0.15 Mn 0.60 | | |
| Yield Strength | PSI | 35,000–45,000 | | |
| | MPA | 240–310 | | |
| Melt (HEAT) | | 800° F. | | |
| Paint Coating (Melt) | | 350°—400° F. | | |
| | mm | (IN) | mm | IN |
| Thickness | 0.38 | 0.015 | 4.27 | 0.166 |
| Elongation in 50 mm (2 inches) % | | 32–42 mm. | | |

Of course, it may be that other high tensile strength strips may also function so long as double sided tape strips 30 may be strongly adhered to them and there are sufficiently strong to transfer a tensile load in direction A to window frame 18.

Figure 2:
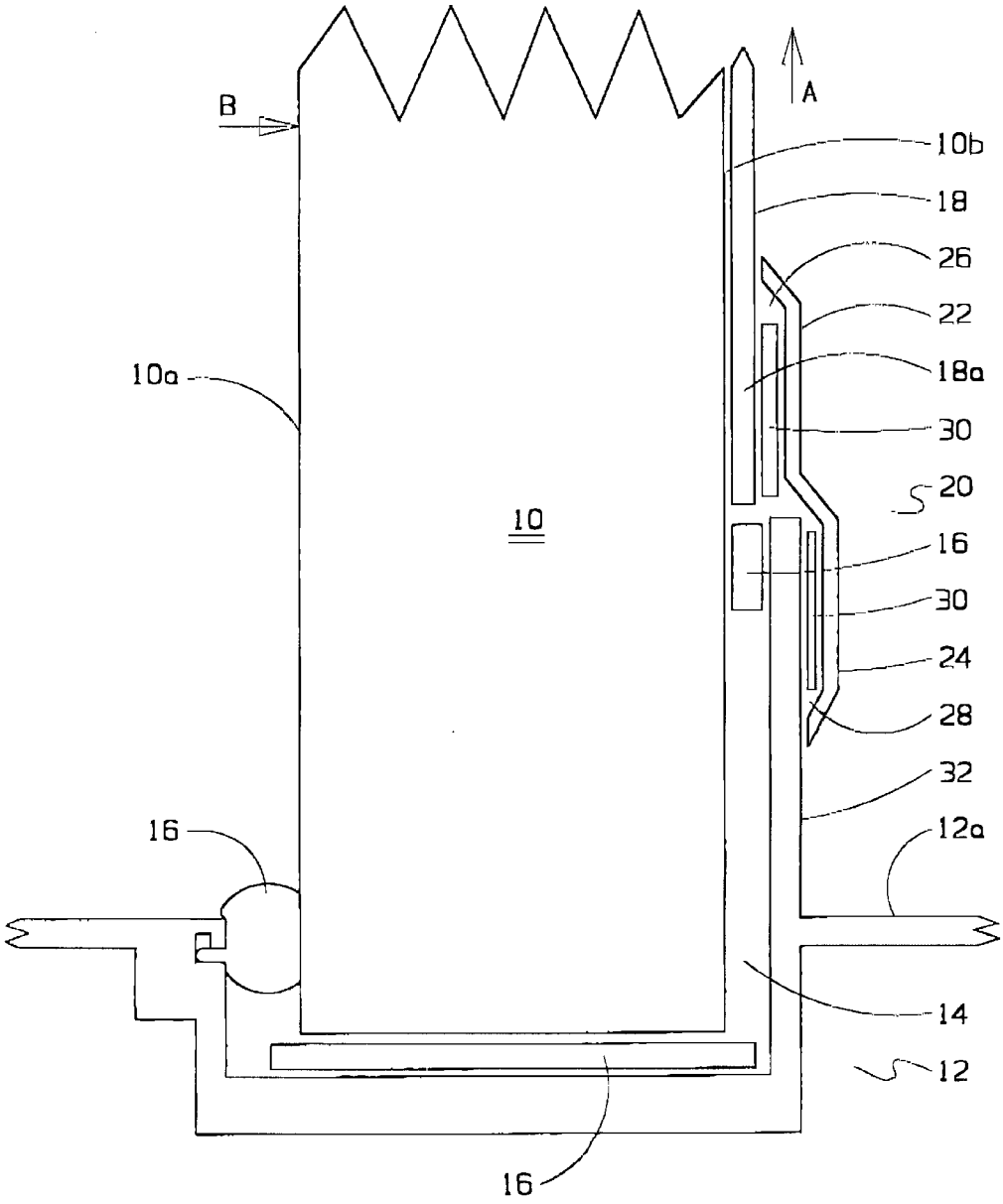
FIG. 2 and FIG. 3 are, alternative embodiments of the edge mounting of window security film to a window frame of the present invention.
Figure 3:
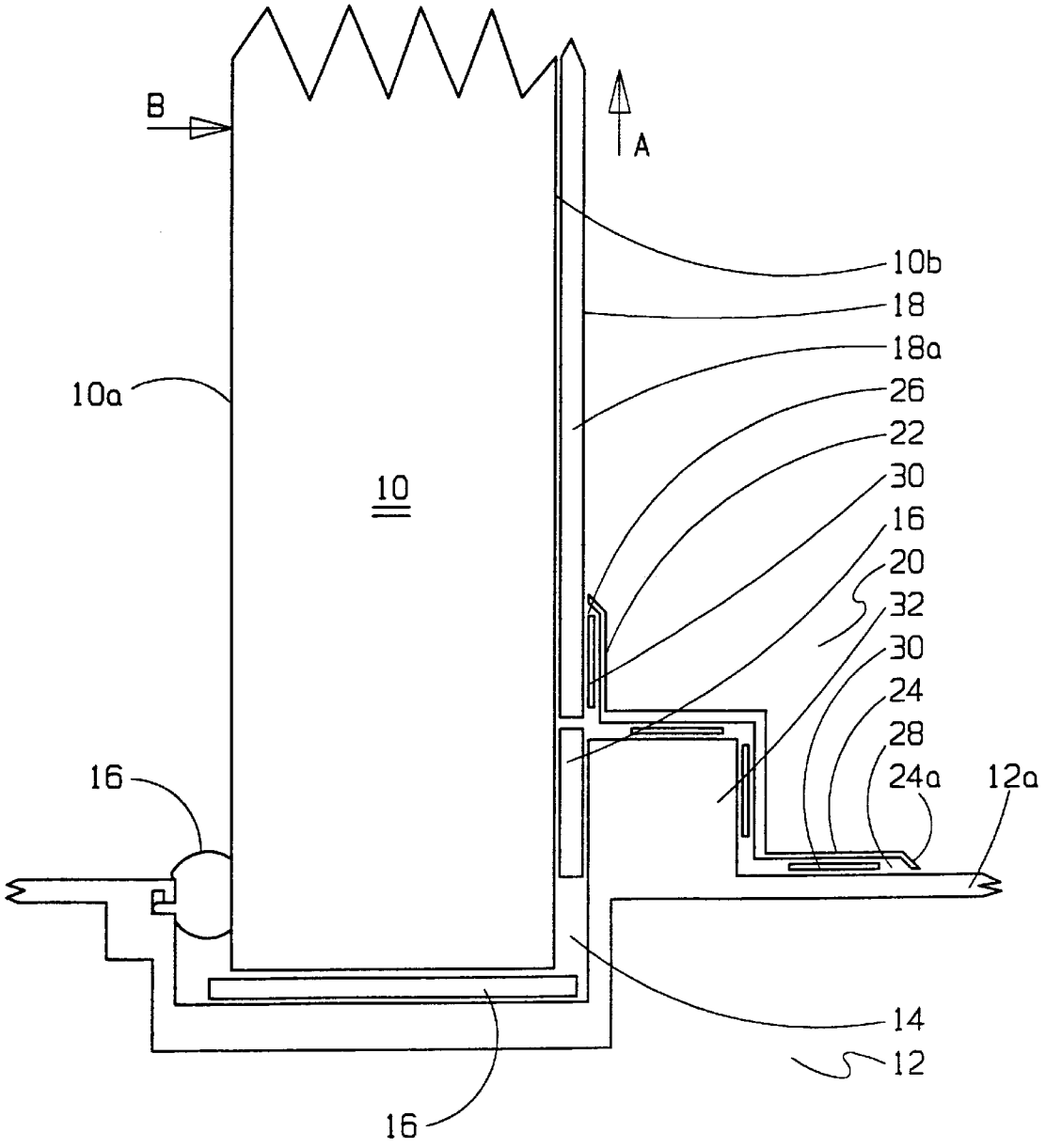

In the embodiments illustrated in FIGS. 2 and 3, tensile loading transfer strips 20 are shaped so as to accommodate differently shaped and sized mullions 32 on the interior of window frame 12.

In FIG. 2, tensile loading transfer strip 20 is generally planar with second bearing flange 24 being offset from first bearing flange 22 by generally the thickness of mullion 32. The end result is the same as the embodiment of FIG. 1 wherein a tensile load applied in direction A to security window film 18 is transferred to window frame 12 via double sided tape strips 30, tensile loading transfer strip 20 and mullion 32. In FIG. 3, transfer of the tensile load does not include transfer of the load through mullion 32 in that tensile loading transfer strip 20 is W shaped to fit over mullion 32 so that first and second bearing flanges 22 and 24 extend outwardly on either side of mullion 32. In this fashion, the tensile load is transferred between security window film 18 and interior surface 12*a* of window frame 12 directly between double sided tape strips 30 via tensile loading transfer strip 20 only.

Figure 4:
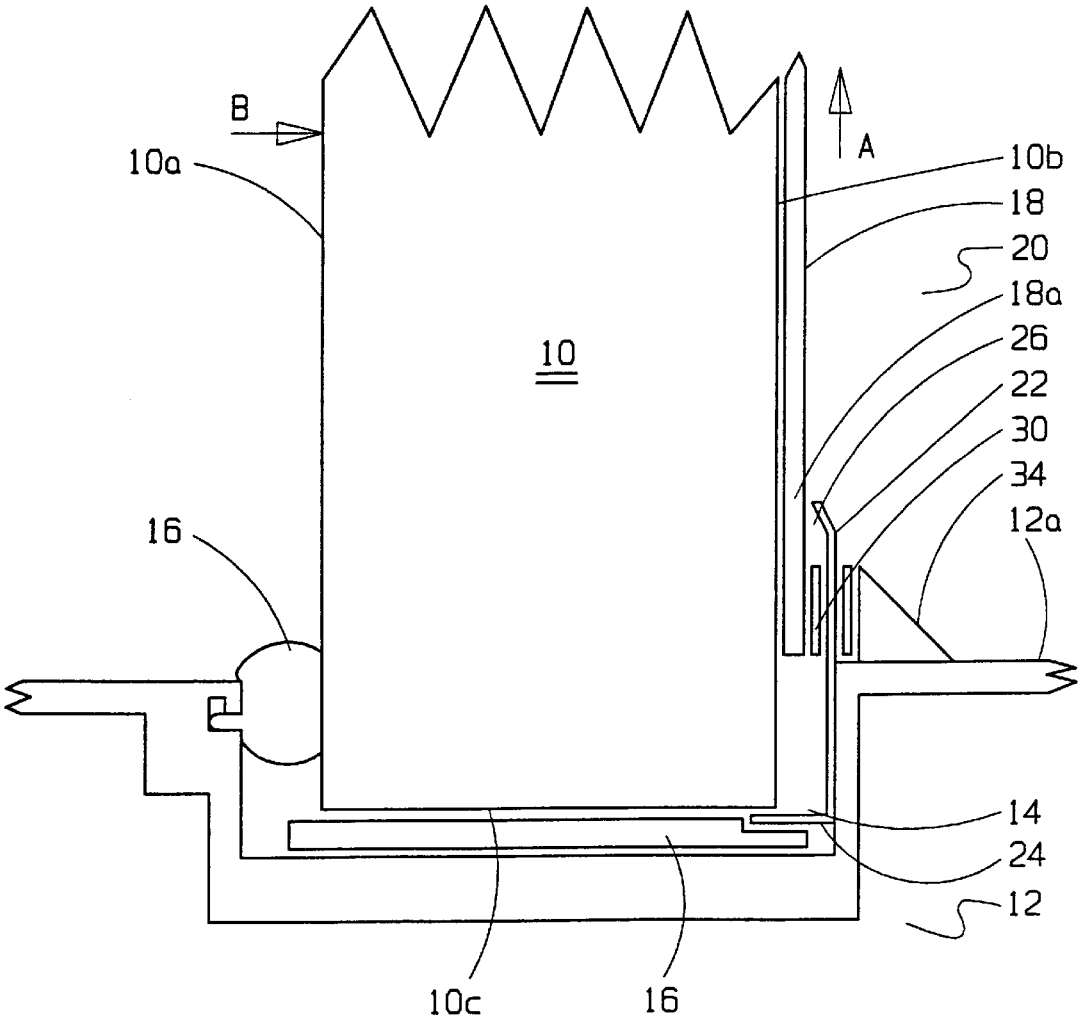
FIG. 4 is, in an enlarged partially broken away cross-sectional view, the adhesive edge mounting of a security window film to an edge of a window pane of the present invention.
Figure 4A:
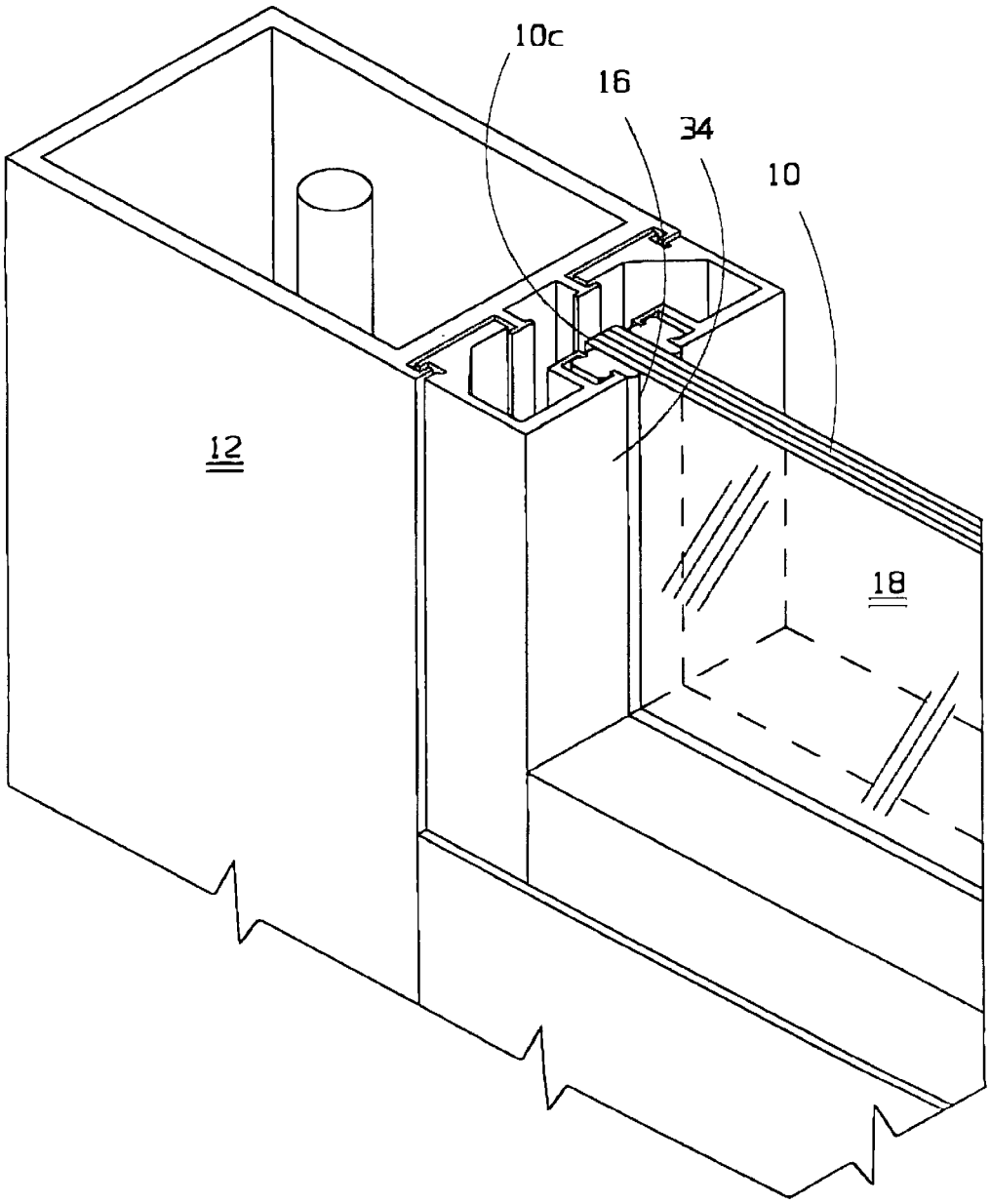
FIG. 4a PRIOR ART
FIG. 4*a* is, in perspective view, a prior art window frame having a glass pane conventionally mounted therein.

In the embodiment illustrated in FIG. 4, tensile loading transfer strip 20 secures security window film 18 at edge portion 18*a* to edge 10*c* of glass window pane 10 rather than window frame 12. In particular, rather than first and second bearing flanges 22 and 24 being bent at 90 degrees with respect to each other so as to direct second bearing flange 24 outwardly of glass window pane 10 and over interior surface 12*a* of window frame 12, second bearing flange 24 is bent inwardly at 90 degrees to first bearing flange 22 so as to form a lip which may be hooked behind glass window pane 10 residing in channel 14 so as to extend second bearing flange 24 at least partially over edge 10*c*. In this embodiment, only one double sided tape strip 30 is required, namely, between edge portion 18*a* of security window film 18 and first bearing flange 22.

Illustrated in FIG. 4 in dotted outline is stop 34 and resilient gasket or wedge 36. In this embodiment, when installing security window film 18, stop 34 and the associated gasket 16 (not shown) is first removed so as to expose more of interior surface 10*b*. Tensile loading transfer strip 20 and its associated double sided tape strip 30 is then installed over edge portion 18*a*. Stop 34 is then reinstalled and a resilient gasket or wedge 36, for example, having a thickness of 0.090 inches, inserted between first bearing flange 22 and stop 34.

Figure 4B:
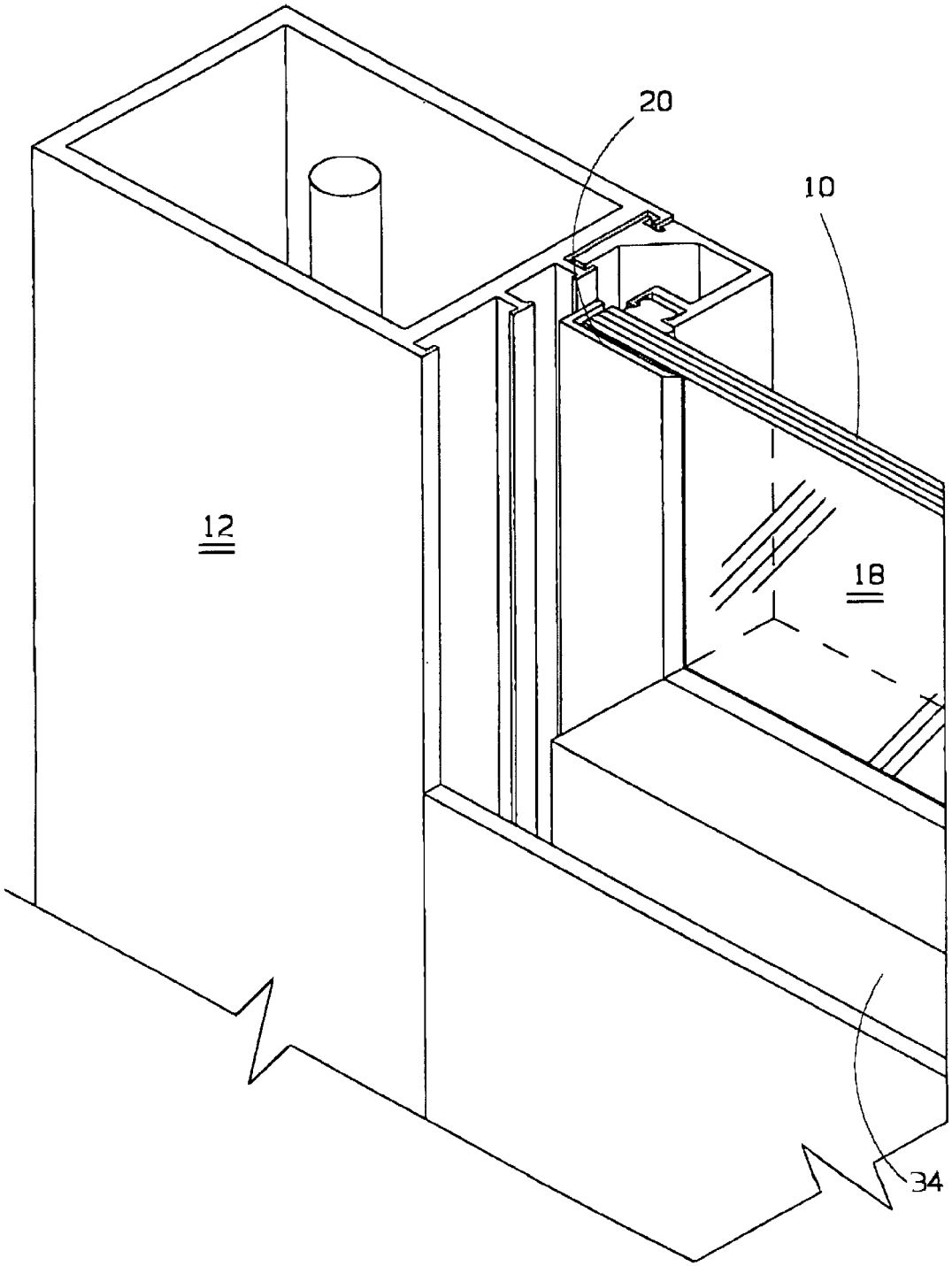
FIG. 4*b* is, in perspective view, the window frame of FIG. 4*a* being modified according to the method of one embodiment of the present invention.
Figure 4C:
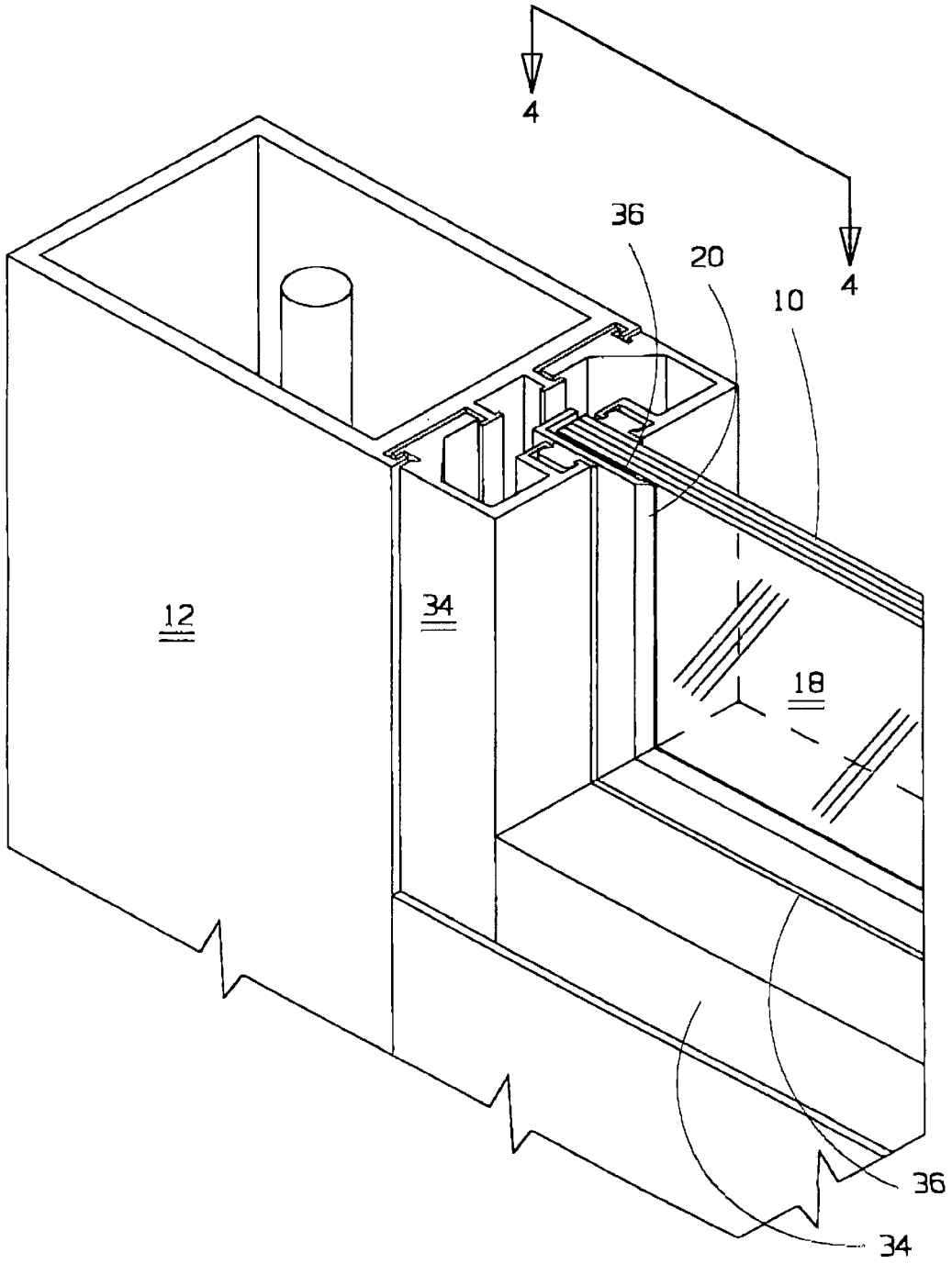
FIG. 4*c* is, in perspective view, the window frame of FIG. 4*a* with one embodiment of the apparatus for edge mounting security window film of the present invention retrofitted thereto.

FIGS. 4*b* and 4*c* illustrate, respectively, the embodiment of FIG. 4 once installed looking from the interior of glass window pane 10 and looking from the exterior of glass window pane 10. In FIG. 4*b*, wedge 36 is being installed into the gap between first bearing flange and stop 34. In FIG. 4*c*, looking through glass window pane 10 from exterior surface 10*a*, double sided tape strip 30 may be viewed as adhesively adhered to interior surface 10*b* and first bearing flange 22 within cavity 26.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A mounting device of a window security apparatus, the device mounting a security film to a window frame, the mounting device comprising;

an elongate tensile loading transfer member having first and second adjacent elongate load bearing flanges and corresponding first and second respective elongate bearing surfaces thereon, first and second elongate double sided foam adhesive tape strips mountable, on first sides of said adhesive tape strips, along respective said first and second bearing surfaces, said first adhesive tape strip mountable on its second side, opposite to said first side, to an edge of a sheet of security window film having a thickness of at least 10mil adhered to a glass window pane, said second adhesive tape strip mountable on its second side, opposite to said first side, to an edge of a window frame adjacent said edge of sheet of security window film, wherein, said first and second adhesive tape strips are adapted to bear approximately 225 lbs per square inch in tension applied to said first and second adhesive tape strips and to said security window film when adhesively mounted to said tensile load transfer member by said first adhesive tape strip and to said window frame when mounted to said tensile load transfer member by said second adhesive tape strip, and wherein said second elongate load bearing flange is bent along an edge thereof so as to form an adhesive tape strip receiving cavity for snugly receiving therein said second elongate double sided foam adhesive tape strip, said edge bent so as to be closely adjacent said window frame when said tensile load transfer member is mounted to said window frame, and wherein said tensile load transfer member is W-shaped in cross-section.

2. The apparatus of claim 1 wherein said first and second adhesive tape strips are adapted to bear approximately 1000 lbs per square inch in tension applied to said tape strips and to said security window film when adhesively mounted to said tensile load transfer member by said first adhesive tape strip and to said window frame when mounted to said tensile load transfer member by said second adhesive tape strip.

3. The apparatus of claim 1 wherein said tensile load transfer member is a metal strip shaped to conform to an intersection between said edge of said sheet of security window film and said edge of said window frame adjacent said edge of said sheet of security window film, and said first and second flanges extend over said edge of said sheet of security window film and said window frame respectively so as to sandwich said first adhesive tape strip between said first flange and said security window film, and so as to sandwich said second adhesive tape strip between said second flange and said window frame.

4. A window security apparatus for resisting high tensile loads applied to a window film when said window film is adhered to a glass pane mounted in a window frame, comprising in combination;

security window film adherable to said glass pane, an elongate tensile loading transfer member having first and second adjacent elongate load bearing flanges and corresponding first and second respective elongate bearing surfaces thereon, first and second elongate double sided foam adhesive tape strips mountable, on first sides of said adhesive tape strips, along respective said first and second bearing surfaces, said first adhesive tape strip mountable on its second side, opposite to said first side, to an edge of a sheet or said security window film having a thickness of at least 10 mil adhered to said glass window pane, said second adhesive tape strip mountable on its second side, opposite to said first side, to an edge of said window frame adjacent said edge of said sheet of said security window film, wherein, said first and second adhesive tape strips are adapted to bear approximately 225 lbs pet square inch in tension applied to said first and second adhesive tape strips and to said security window film when adhesively mounted to said tensile load transfer member by said first adhesive tape strip and to said window frame when mounted to said tensile load transfer member by said second adhesive tape strip, and wherein said second elongate load bearing flange is bent alone an edge thereof so as to form an adhesive tape strip receiving cavity for snugly receiving therein said second elongate double sided foam adhesive tape strip, said edge bent so as to be closely adjacent said window frame when said tensile load transfer member is mounted to said window frame, and wherein said tensile load transfer member is W-shaped in cross-section.

* * * * *